US009401105B2

(12) United States Patent
Cho

(10) Patent No.: US 9,401,105 B2
(45) Date of Patent: Jul. 26, 2016

(54) DISPLAY DEVICE AND METHOD OF OPERATING THE SAME

(71) Applicant: Samsung Display Co., Ltd., Yongin, Gyeonggi-Do (KR)

(72) Inventor: Dong-Beom Cho, Asan-si (KR)

(73) Assignee: Samsung Display Co., Ltd. (KR)

( * ) Notice: Subject to any disclaimer, the term of this patent is extended or adjusted under 35 U.S.C. 154(b) by 449 days.

(21) Appl. No.: 13/866,902

(22) Filed: Apr. 19, 2013

(65) Prior Publication Data

US 2014/0125639 A1 May 8, 2014

(30) Foreign Application Priority Data

Nov. 6, 2012 (KR) ..... 10-2012-0124930

(51) Int. Cl.

| | |
|---|---|
| ***G09G 3/20*** | (2006.01) |
| ***G09G 3/32*** | (2006.01) |
| ***G09G 3/36*** | (2006.01) |
| ***G09G 5/18*** | (2006.01) |

(52) U.S. Cl.

CPC .. *G09G 3/20* (2013.01); *G09G 5/18* (2013.01); *G09G 2310/027* (2013.01); *G09G 2310/08* (2013.01); *G09G 2330/021* (2013.01); *G09G 2340/0442* (2013.01); *G09G 2370/08* (2013.01); *G09G 2370/14* (2013.01)

(58) Field of Classification Search

CPC ..... G09G 3/342; G09G 2310/062; G09G 3/3688; G09G 5/005

USPC ..... 345/56, 99, 204, 208, 213, 419, 698

See application file for complete search history.

(56) References Cited

U.S. PATENT DOCUMENTS

| | | | | |
|---|---|---|---|---|
| 6,181,317 | B1 * | 1/2001 | Taguchi | G09G 3/3677 345/698 |
| 6,236,388 | B1 | 5/2001 | Iida et al. | |
| 6,583,779 | B1 | 6/2003 | Ushirono | |
| 7,477,272 | B2 | 1/2009 | Baek et al. | |
| 2007/0291512 | A1 * | 12/2007 | Lee | G02F 1/133604 362/633 |
| 2008/0100595 | A1 * | 5/2008 | Wu | G09G 3/20 345/204 |
| 2009/0201272 | A1 * | 8/2009 | Ahn | G09G 3/2096 345/204 |
| 2010/0045644 | A1 * | 2/2010 | Lee | G09G 3/3233 345/208 |
| 2010/0171688 | A1 * | 7/2010 | Wang | G09G 3/3611 345/99 |
| 2012/0133635 | A1 * | 5/2012 | Ji | G09G 3/3688 345/212 |
| 2013/0010001 | A1 * | 1/2013 | Lin | G09G 3/3406 345/690 |

FOREIGN PATENT DOCUMENTS

| | | |
|---|---|---|
| JP | 10-150614 | 6/1998 |
| JP | 2000-267066 | 9/2000 |

(Continued)

*Primary Examiner* — Lin Li

(74) *Attorney, Agent, or Firm* — Innovation Counsel LLP

(57) ABSTRACT

A display device is provided which includes a display panel including a plurality of pixels; a gate driving unit configured to drive gate lines; a data driver configured to drive data lines; and a timing controller configured to generate a plurality of control signals for controlling the gate driving unit and the data driver. The timing controller converts the data signals into an image data signal, a horizontal synchronization signal, a vertical synchronization signal, and a data enable signal, a pulse width of each of the horizontal and vertical synchronization signals corresponding to an aspect ratio of the data signals or a size of a black image display area. The timing controller generates the plurality of control signals according to the image data signal, the data enable signal, and pulse widths of the horizontal synchronization signal and the vertical synchronization signal.

18 Claims, 14 Drawing Sheets

(56) References Cited

FOREIGN PATENT DOCUMENTS

| | | |
|---|---|---|
| JP | 2003-005722 | 1/2003 |
| JP | 2004-118217 | 4/2004 |
| JP | 2004-177557 | 6/2004 |
| JP | 2005-025076 | 1/2005 |
| JP | 2005-221695 | 8/2005 |
| JP | 2006-154224 | 6/2006 |
| JP | 2010-160492 | 7/2010 |
| KR | 10-2002-0063034 | 8/2002 |

* cited by examiner

DISPLAY DEVICE AND METHOD OF OPERATING THE SAME

CROSS-REFERENCE TO RELATED APPLICATIONS

This application claims priority under 35 U.S.C. §119 to Korean Patent Application No. 10-2012-0124930, filed on Nov. 6, 2012, the disclosure of which is incorporated by reference herein in its entirety.

BACKGROUND

The inventive concepts described herein relate to generally a flat panel display device, and more particularly relate to a display device capable of displaying image signals having various aspect ratios and an operating method thereof.

A proportional relationship between a width and a height (hereinafter, referred to as an aspect ratio) of a display device may be varied such as 4:3, 5:4, 16:9, 16:10, 21:9, and so on. A format of an externally provided image signal may be altered to have a same aspect ratio of a display panel to display an image.

Although the externally provided image signal has a different aspect ratio from an aspect ratio of a display device, it must be displayed on the display panel. For example, when an image signal having an aspect ratio of 4:3 is provided to a display device having an aspect ratio of 16:9, the display device may display the 4:3 image signal in a manner where the image is displayed at a part of a display panel. In this case, the image may be displayed at a part of a display panel having an aspect ratio of 16:9, and an image corresponding to a black image signal may be displayed at the remaining area.

As aspect ratios of a display panel and an image signal vary, a display device need to sense an aspect ratio of the image signal and display the image signal at a display mode suitable for the sensed aspect ratio.

In recent years, a design for reducing power consumption of the display device becomes important. Therefore, new design of a display device capable of minimizing unnecessary power consumption is required.

SUMMARY

One aspect of embodiments of the inventive concept is directed to provide a display device which comprises a display panel including a plurality of pixels connected with a plurality of gate lines and a plurality of data lines; a gate driving unit configured to drive the plurality of gate lines; a data driver configured to drive the plurality of data lines; and a timing controller configured to generate a plurality of control signals for controlling the gate driving unit and the data driver in response to externally provided clock signal and data signals, wherein the timing controller converts the data signals into an image data signal, a horizontal synchronization signal, a vertical synchronization signal, and a data enable signal, a pulse width of each of the horizontal and vertical synchronization signals corresponds to an aspect ratio of the data signals or a size of a black image display area; and wherein the timing controller generates the plurality of control signals according to the image data signal, the data enable signal, and pulse widths of the horizontal synchronization signal and the vertical synchronization signal.

In example embodiments, the timing controller comprises a receiving unit configured to convert the clock signal and the data signals into the image data signal, the horizontal synchronization signal, the vertical synchronization signal, and the data enable signal; and a control signal generating unit configured to generate the plurality of control signals according to the image data signal, the data enable signal, and the pulse widths of the horizontal synchronization signal and the vertical synchronization signal.

In example embodiments, the timing controller further comprises a memory configured to store a pulse width setup signal corresponding to an aspect ratio of the data signals.

In example embodiments, the pulse width setup signal is a signal for changing a pulse width of at least one of the horizontal synchronization signal and the vertical synchronization signal.

In example embodiments, the timing controller changes an activation point of time of the horizontal synchronization signal in response to the pulse width setup signal.

In example embodiments, the timing controller changes an activation point of time of the vertical synchronization signal in response to the pulse width setup signal.

In example embodiments, the timing controller changes an inactivation point of time of the vertical synchronization signal in response to the pulse width setup signal.

In example embodiments, the timing controller changes an activation point of time of the vertical synchronization signal and an activation point of time of the horizontal synchronization signal in response to the pulse width setup signal.

In example embodiments, the plurality of control signals generated by the timing controller includes a gate pulse signal to be provided to the gate driving unit and a mode signal and an image signal to be provided to the data driver.

In example embodiments, the timing controller changes at least one of the gate pulse signal and the mode signal when an aspect ratio of the data signals is different from a predetermined aspect ratio or a black image display area is detected.

In example embodiments, the timing controller sets the mode signal to a first level when the aspect ratio of the data signals is less than the aspect ratio of the display panel.

In example embodiments, the data driver does not provide the image signal to a data line connected with pixels placed at a part of the display panel when the mode signal has the first level.

In example embodiments, the timing controller sets a predetermined period of the gate pulse signal to a turn-off level when the aspect ratio of the data signals is different from the predetermined aspect ratio or the black image display area is detected.

In example embodiments, the gate driving unit comprises a level shifter configured to output a gate clock signal in response to the gate pulse signal; and a gate driver configured to sequentially drive the plurality of gate lines in response to the gate clock signal, wherein the gate driver does not drive a corresponding gate line during the turn-off level of the gate clock signal.

One aspect of embodiments of the inventive concept is directed to provide a display device driving method which comprises receiving a clock signal and data signals from an external device; converting the clock signal and the data signals into an image data signal, a horizontal synchronization signal, a vertical synchronization signal, and a data enable signal; and displaying an image on a display panel in response to the image data signal, the horizontal synchronization signal, the vertical synchronization signal, and the data enable signal, wherein the converting the clock signal and the data signals comprises changing at least one of a pulse width of the horizontal and vertical synchronization signals corresponding to an aspect ratio of the data signals or a size of a black image display area.

One aspect of embodiments of the inventive concept is directed to provide a display device driving method which comprises receiving a clock signal and data signals from an external device; comparing an aspect ratio of the data signals and the display device, and disabling data lines or gate lines of the display device which do not have corresponding data in the data signals. The comparing an aspect ratio of the data signals and the display device comprises counting numbers of the gate lines and data lines of the data signals from the external device; and comparing the numbers of the gate lines and the data lines of the data signals from the external device, and numbers of gate lines and data lines of the display device.

The disabling data lines or gate lines of the display device is performed by a mode signal or a gate pulse signal generated by a timing controller. The mode signal comprises disable signals for the data lines which do not have corresponding data in the data signals and the gate pulse signal comprises disable signals for the gate lines which do not have corresponding data in the data signals.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
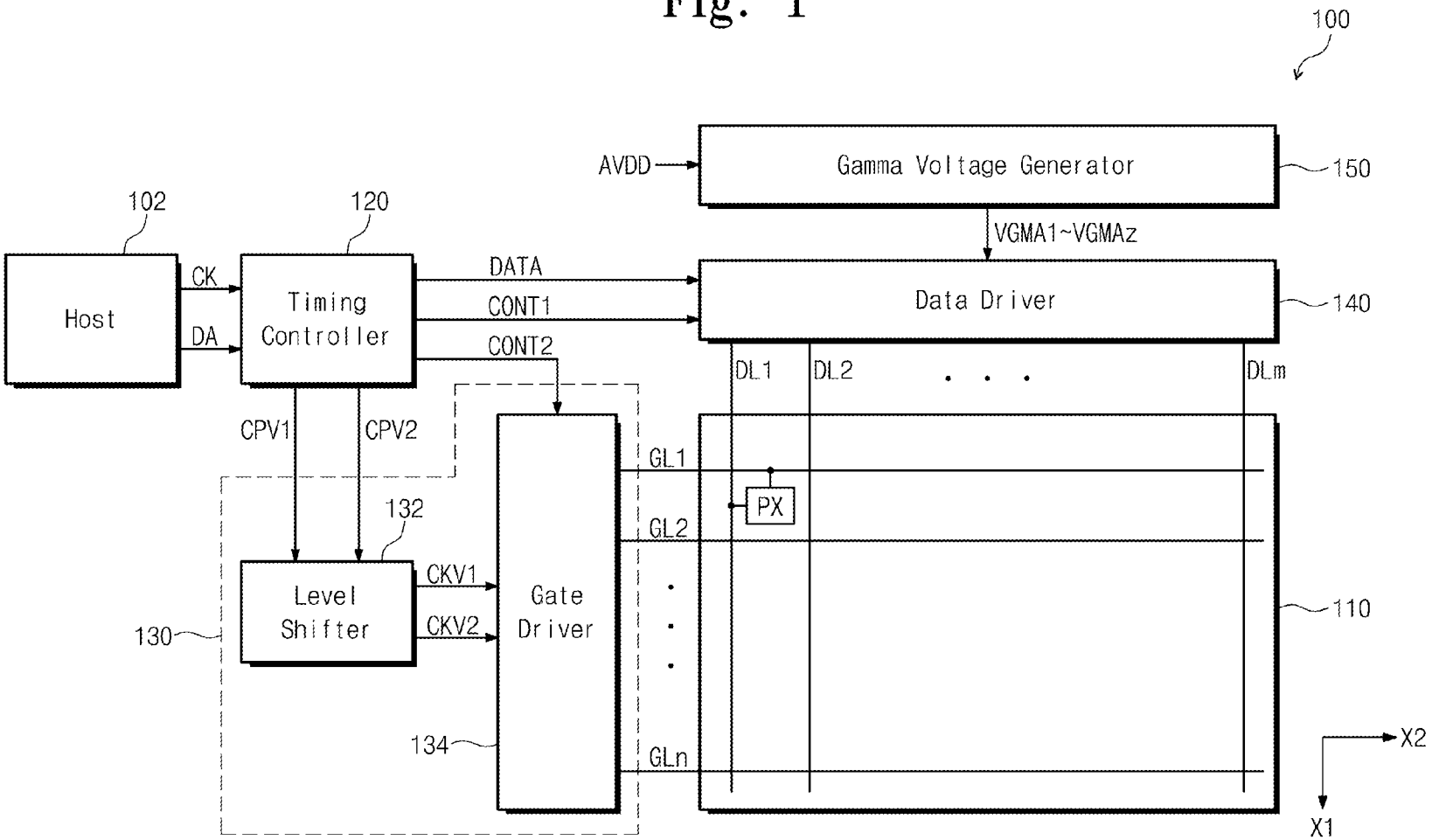
FIG. 1 is a block diagram schematically illustrating a display device according to an embodiment of the inventive concept.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

FIG. 1 is a block diagram schematically illustrating a display device according to an embodiment of the inventive concept.

Referring to FIG. 1, a display device 100 may receive a clock signal CK and a data signal DA from a host 102. The display device 100 may include a display panel 110, a timing controller 120, a gate driver unit 130, a data driver 140, and a gamma voltage generator 150. The gate driver unit 130 may include a level shifter 132 and a gate driver 134.

The display panel 110 may include a plurality of data lines DL1 to DLm extending in a first direction X1, a plurality of gate lines GL1 to GLn extending in a second direction X2 to be intersected with the data lines DL1 to DLm, and a plurality of pixels PX arranged at intersections of the data lines DL1 to DLm and the gate lines GL1 to GLn.

Although not shown in FIG. 1, each pixel PX may include a switching transistor connected with a corresponding data line and a corresponding gate line and a liquid crystal capacitor and a storage capacitor connected with the switching transistor.

The timing controller 120 may receive the clock signal CK and the data signal DA from the external host 102. The data signal DA may include an image signal and control signals for controlling a display of the image signal, for example, a horizontal synchronization signal, a vertical synchronization signal, a data enable signal, and so on. The timing controller 120 may convert the clock signal CK and the data signal DA into an image signal RGB, a main clock signal MCLK, a vertical synchronization signal VSYNC, a horizontal synchronization signal HSYNC, and a data enable signal DE. The timing controller 120 may provide a data signal DATA and a first control signal CONT1 to the data driver 140 and a second control signal CONT2 to the gate driver 134. Herein, the data signal DATA may be generated by processing the image signal RGB to be suitable for an operating condition of the display panel 110 based on the main clock signal MCLK, the vertical synchronization signal VSYNC, the horizontal synchronization signal HSYNC, and the data enable signal DE. The first control signal CONT1 may include a horizontal synchronization start signal STH, a clock signal HCLK, and a line latch signal TP, and the second control signal CONT2 may include a vertical synchronization start signal STV1 and an output enable signal OE.

The gamma voltage generator 150 may generate a plurality of gamma voltages VGMA1 to VGMAz.

The data driver 140 may output gray scale voltages for driving the data lines DL1 to DLm using the plurality of gamma voltages VGMA1 to VGMAz in response to the data signal DATA and the first control signal CONT1 from the timing controller 120.

The level shifter 132 may output first and second gate clock signals CKV1 and CKV2 in response to first and second gate pulse signals CPV1 and CPV2 from the timing controller 120.

The gate driver 134 may drive the gate lines GL1 to GLn in response to the second control signal CONT2 from the timing controller 120 and the first and first and the second gate clock signals CKV1 and CKV2 from the level shifter 132. The gate driver 134 may be implemented by thin film transistors using amorphous silicon, oxide semiconductor, crystalline semiconductor, or polycrystalline semiconductor, or a gate driver integrated circuit (IC).

While a gate on voltage VON is applied to a gate line, a row of switching transistors connected with the gate line may be turned on. At this time, the data driver 140 may provide the data lines DL1 to DLm with gray scale voltages corresponding to the data signal DATA. The gray scale voltages supplied to the data lines DL1 to DLm may be applied to corresponding pixels via the turned-on switching transistors. Herein, a turn-on period of a row of switching transistors, that is, one period of the data enable signal DE and the first and the second gate clock signals CKV1 and CKV2 may be referred to as "1 horizontal period" or "1H".

Figure 2:
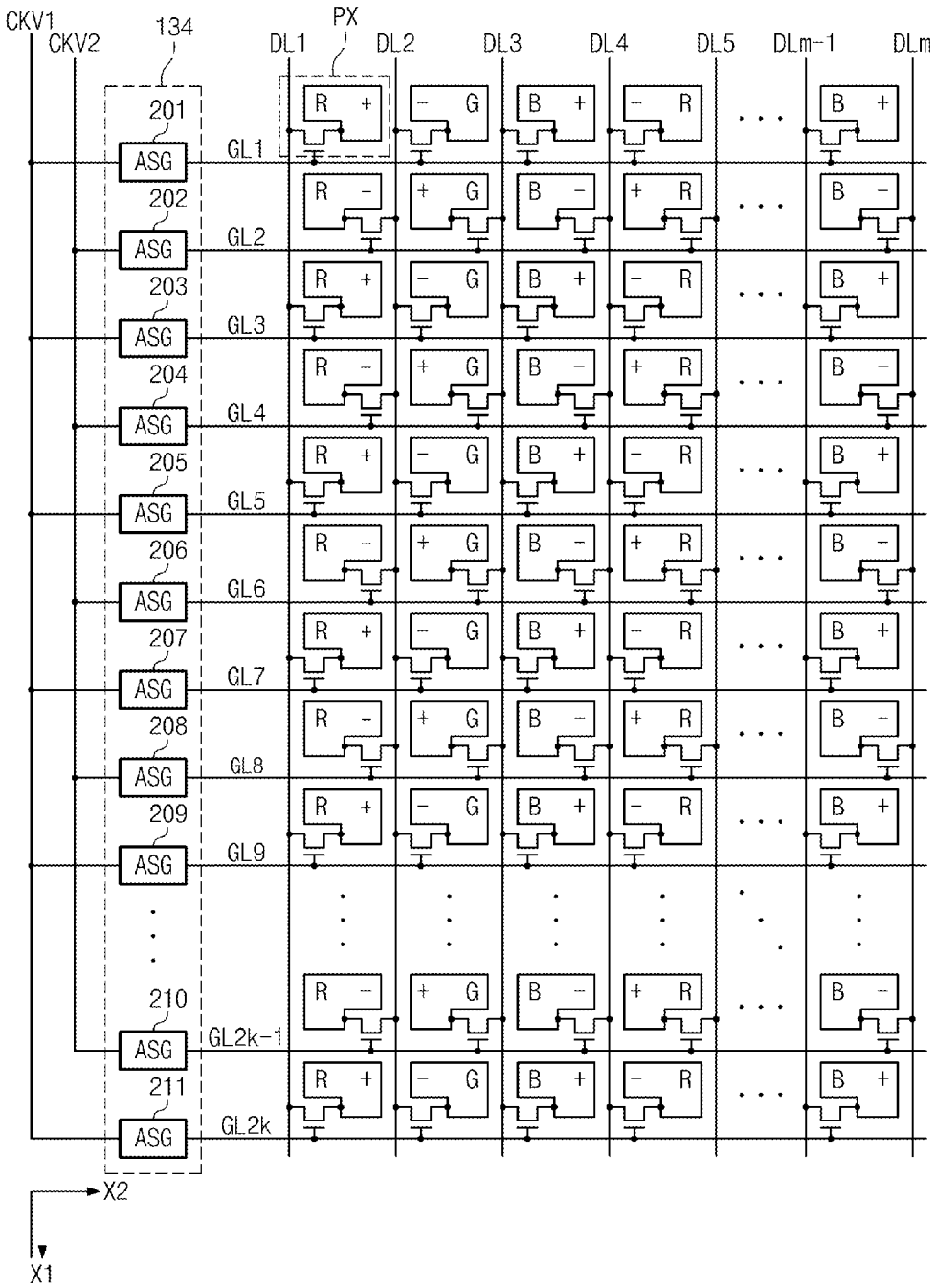
FIG. 2 is a diagram illustrating configuration of a gate driver and arrangement of pixels in a display panel of FIG. 1.

FIG. 2 is a diagram illustrating configuration of a gate driver and arrangement of pixels in a display panel of FIG. 1.

Referring to FIG. 2, a gate driver 134 may include amorphous silicon gate (hereinafter, referred to as 'ASG') circuits 201 to 211 corresponding to gate lines GL1 to GLn, respectively. A first gate clock signal CKV1 from a level shifter 132 may be provided to the ASG circuits 201, 203, 205, . . . , 209 connected with odd-numbered gate lines GL1, GL3, GL5, . . . , GL2k−1, respectively, and a second gate clock signal CKV2 may be provided to the ASG circuits 202, 204, 206, . . . , 211 connected with even-numbered gate lines GL2, GL4, GL6, . . . , GL2k, respectively (2k is equal to n). In FIG. 2, there is illustrated an example in which the gate driver 134 is formed of the ASG circuits 201 to 211. However, the inventive concept is not limited thereto. For example, the gate driver 134 may be implemented by an integrated circuit to be mounted at one side of the display panel 110.

In the display panel 110, one pixel PX may include primary color pixels like a red pixel, a green pixel, or a blue pixel.

Each of the switching transistors may be connected to a corresponding data line, a corresponding gate line and a corresponding pixel electrode. The pixels PX may be arranged in a matrix. The primary color pixels may be disposed sequentially in an extending direction of a gate line, that is, a second direction X2, and pixels having the same color may be disposed in an extending direction of a data line, that is, a first direction X1. For example, the red pixels R may be disposed at a right side of a data line DL1, the green pixels G may be disposed between data lines DL2 and DL3, and the blue pixels B may be disposed between data lines DL3 and DL4. In example embodiments, red, green, and blue pixels R, G, and B may be sequentially disposed in the second direction X2 being an extending direction of a gate line. An arrangement order of pixels may be variously changed like (R, B, G), (G, B, R), (G, R, B), (B, R, G), (B, G, R), and so on.

Arrangement and interconnection of gate lines, data lines, and pixels of the display panel 110 may not be limited to that illustrated in FIG. 2. For example, arrangement and interconnection of gate lines, data lines, and pixels of the display panel 110 may be changed variously.

FIGS. 3 to 6 are diagrams illustrating an image display method according to a relationship between an aspect ratio of an externally provided image signal and an aspect ratio of a display panel illustrated in FIG. 1.

Figure 3:
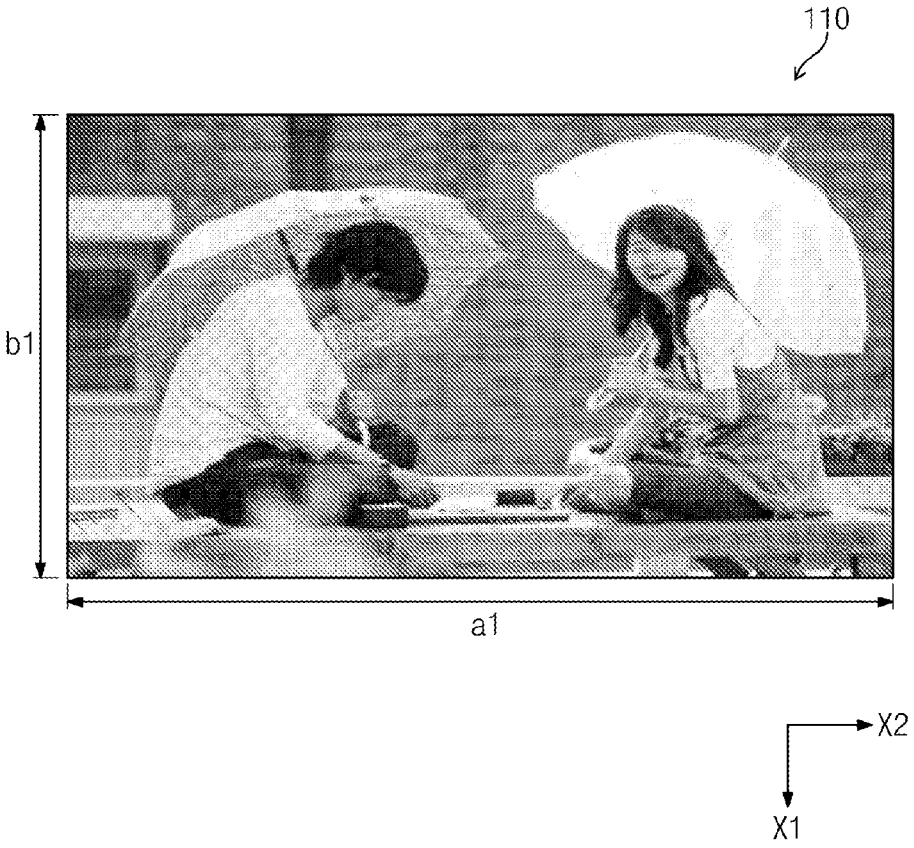
FIGS. 3 to 6 are diagrams illustrating an image display method according to relationship between an aspect ratio of an externally provided image signal and an aspect ratio of a display panel illustrated in FIG. 1.

Referring to FIG. 3, in a display area of a display panel 100 in FIG. 1, a horizontal direction, that is, a length of a second direction X2 may be "a1", and a vertical direction, that is, a length of a first direction X1 may be "b1". That is, an aspect ratio may be "a1:b1". In the case that an aspect ratio of an externally provided image signal coincides with an aspect ratio (a1:b1) of a display panel 110 illustrated in FIG. 1, an image may be displayed at an entire display area of the display panel 110.

Figure 4:
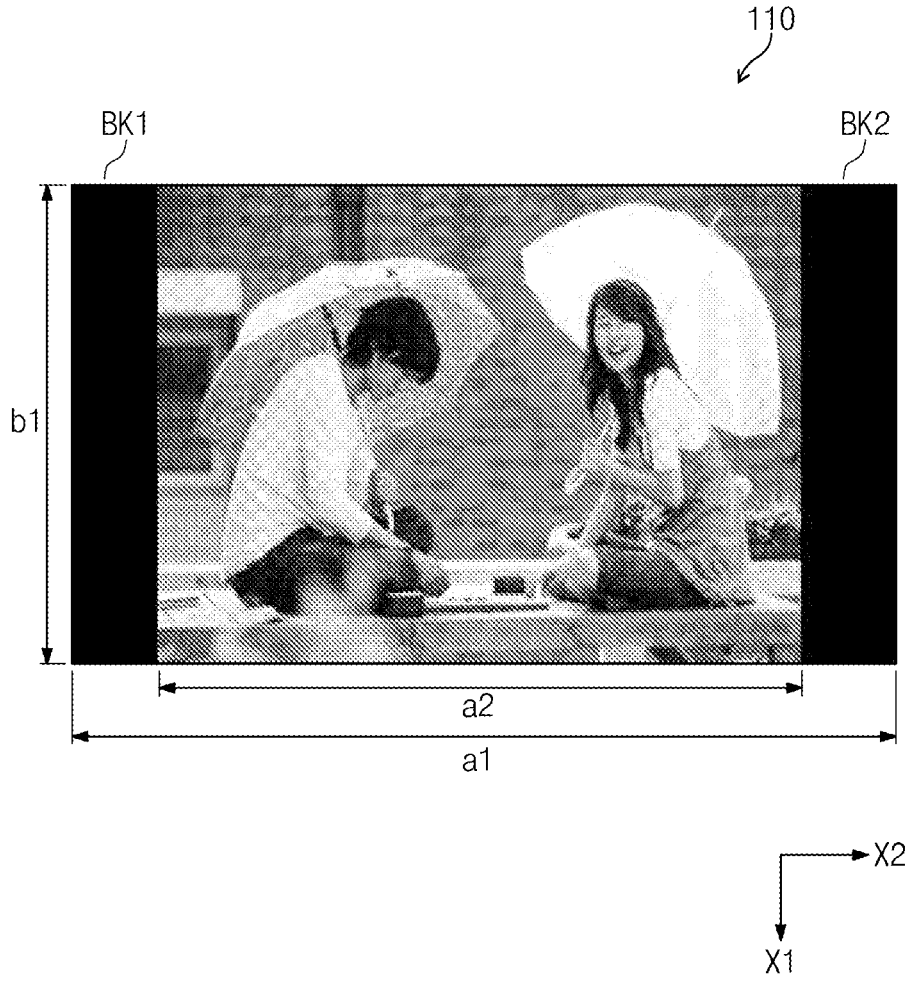

FIG. 4 is a diagram illustrating an image display method when a second-direction length of an image signal is shorter than a second-direction length of a display area of a display panel of FIG. 1. When a second-direction length a2 of an image signal is shorter than a second-direction length a1 of a display area of a display panel 110, a display device 100 may display a black image at left and right sides of the display panel 110. A size of each of black image display areas BK1 and BK2 at the left and the right sides of the display panel 110 may be changed according to the second-direction length a1 of the display area of the display panel 110 and a second-direction length a2 of an image signal.

Figure 5:
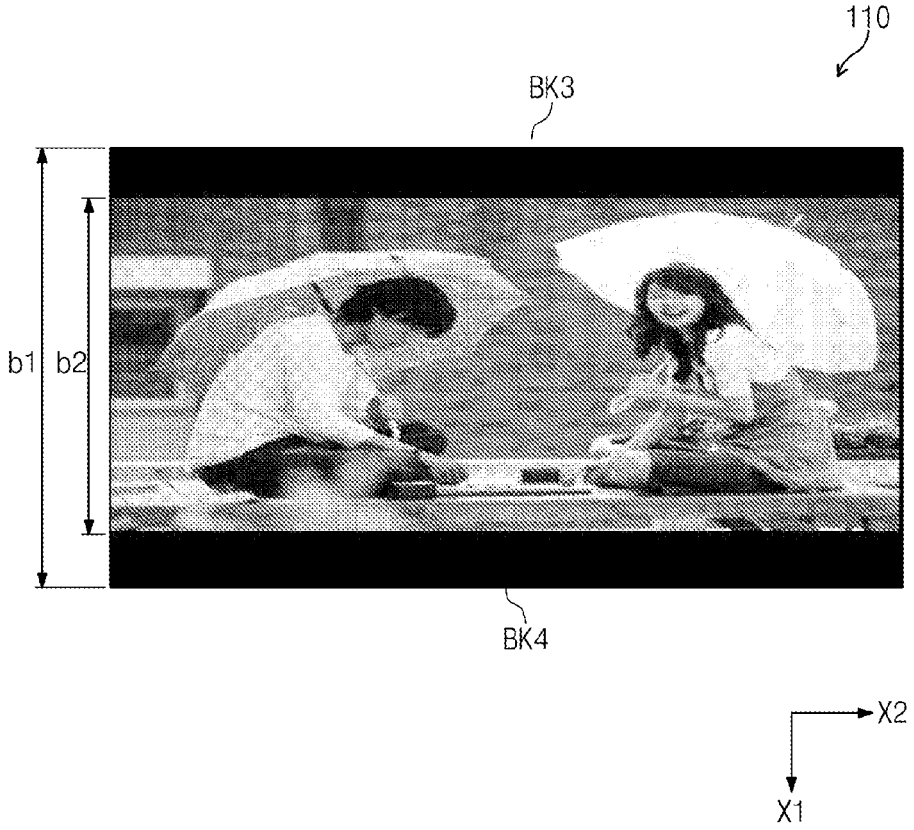

FIG. 5 is a diagram illustrating an image display method when a first-direction length of an image signal is shorter than a first-direction length of a display area of a display panel of FIG. 1. When a first-direction length b2 of an image signal is shorter than a first-direction length b1 of a display area of a display panel 110, a display device 100 may display a black image at upper and lower sides of the display panel 110. A size of each of black image display areas BK3 and BK4 at the upper and the lower sides of the display panel 110 may be changed according to the first-direction length b1 of the display area of the display panel 110 and a first-direction length b2 of an image signal.

Figure 6:
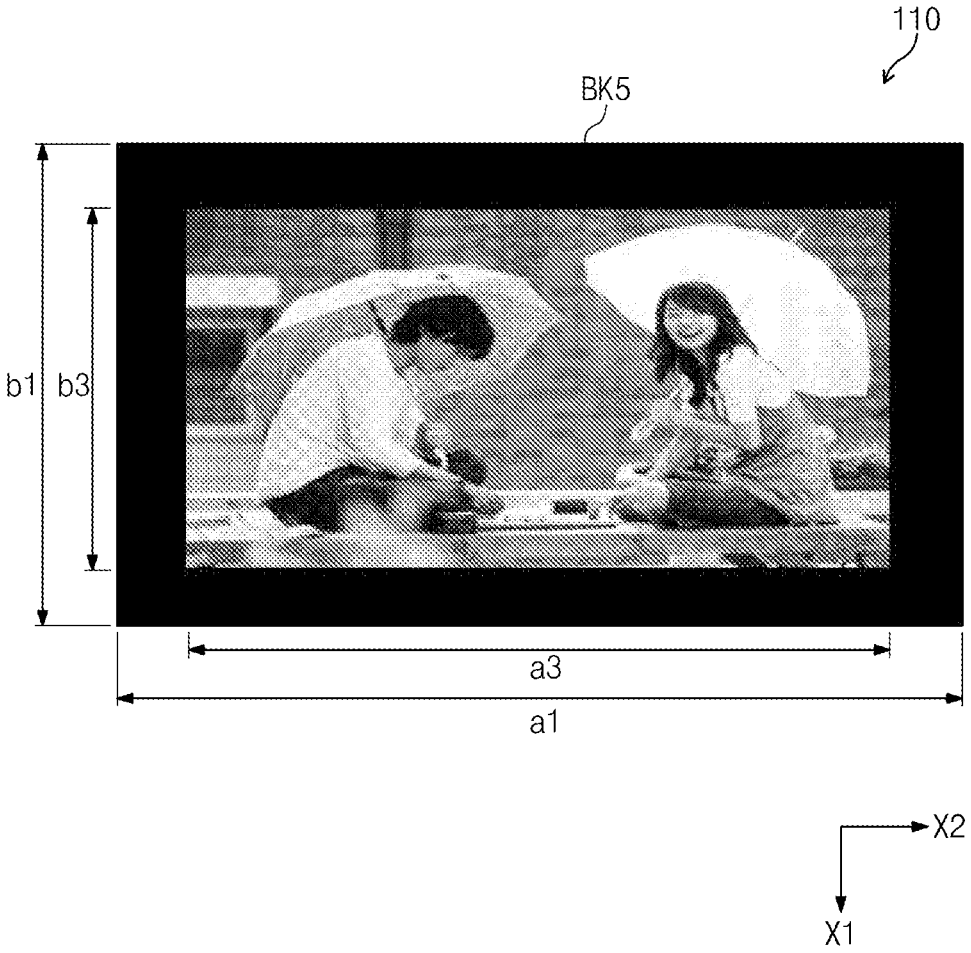

FIG. 6 is a diagram illustrating an image display method when first-direction and second-direction lengths of an image signal are shorter than first-direction and second-direction lengths of a display area of a display panel of FIG. 1. When a first-direction length b3 of an image signal is shorter than a first-direction length b1 of a display area of a display panel 110 and a second-direction length a3 of the image signal is shorter than a second-direction length a1 of the display area of the display panel 110, the display device 100 may display a black image at upper and lower sides and left and right sides of the display panel 110. A size of a black image display area BK5 at the edge of an area where an image is displayed at the display panel 110 may be changed according to sizes a1 and b1 of the display area of the display panel 110 and sizes a3 and b3 of the image signal.

Figure 7:
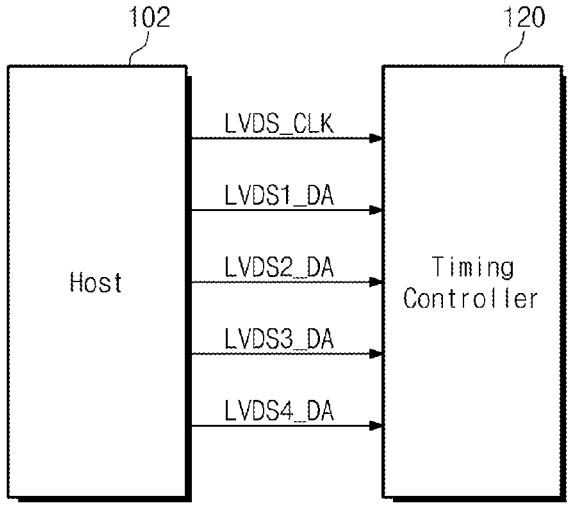
FIG. 7 is a diagram illustrating interconnection between a host and a timing controller.
Figure 8:
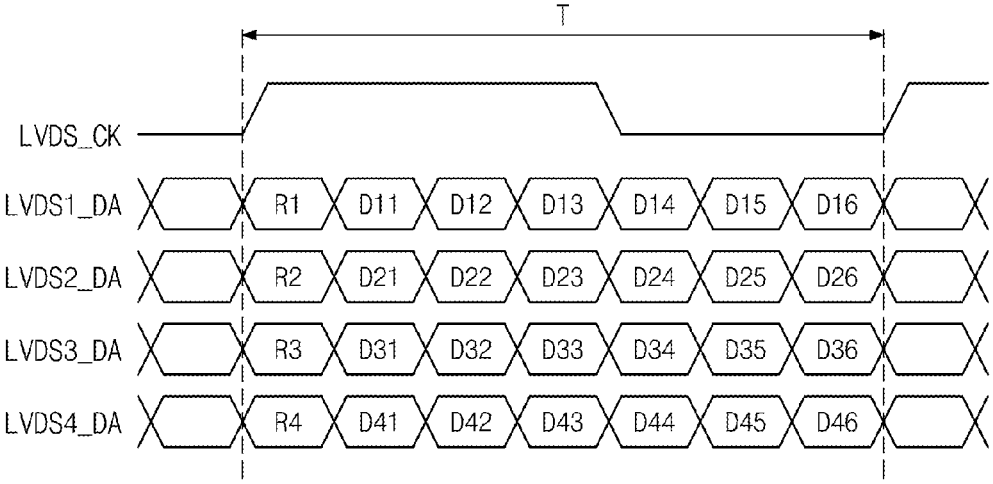
FIG. 8 is a diagram illustrating signals transferred from a host to a timing controller.

FIG. 7 is a diagram illustrating interconnection between a host and a timing controller. FIG. 8 is a diagram illustrating signals transferred from a host to a timing controller.

Referring to FIGS. 7 and 8, a host 102 may transmit signals to a timing controller 120 using a low voltage differential signaling (LVDS) standard. As illustrated in FIG. 8, the LVDS may use a pair of signals having different voltages and a receiver restores an original signal via comparison of the pair of signals. Since an amplitude of a signal is small and two twisted wires are electromagnetically coupled, an emitted electromagnetic noise and power consumption due to the electromagnetic noise is less. Thus, the LVDS may be widely used as an interface for connecting the host 102 and the timing controller 120 of a display device 100.

The host 102 may send a clock signal LVDS_CLK and four pairs of data signals LVDS1_DA, LVDS2_DA, LVDS3_DA, and LVDS4_DA to the timing controller 120. One period of each of the data signals LVDS1_DA, LVDS2_DA, LVDS3 DA, and LVDS4_DA provided from the host 102 to the timing controller 120 may include one reserved bit and six pixel data bits. For example, the data signal LVDS1_DA may include one reserved bit R1 and six pixel data bits D11 to D16.

In general, an aspect ratio of a digital television may be 16:9. In the case that aspect ratios of the data signals LVDS1_DA, LVDS2_DA, LVDS3_DA, and LVDS4_DA are 16:9, the host 102 may set a bit value of each of reserved bits R1, R2, R3, and R4 to '0'. In the case that aspect ratios of the data signals LVDS1_DA, LVDS2_DA, LVDS3_DA, and LVDS4_DA are not 16:9 (e.g., being 4:3), the host 102 may set a bit value of each of reserved bits R1, R2, R3, and R4 to '1'.

The timing controller 120 may sense a size of a display image according to bit values of the reserved bits R1, R2, R3, and R4 in the data signals LVDS1_DA, LVDS2_DA, LVDS3_DA, and LVDS4_DA provided from the host 102. In the case that bit values of the reserved bits R1, R2, R3, and R4 in the data signals LVDS1_DA, LVDS2_DA, LVDS3_DA, and LVDS4_DA are '0', the timing controller 120 may operate at a normal mode. On the other hand, in the case that bit values of the reserved bits R1, R2, R3, and R4 in the data signals LVDS1_DA, LVDS2_DA, LVDS3_DA, and LVDS4_DA are '1', the timing controller 120 may operate at a down-sizing mode. The timing controller 120 may display an image at a display panel 110 in one of manners described with reference to FIGS. 4 to 6, based on the number of data signals LVDS1_DA, LVDS2_DA, LVDS3_DA, and LVDS4_DA in a received frame.

With the above-described aspect ratio determining manner, it is only possible to sense whether an aspect ratio of the display device 100 is the same as that of the data signals LVDS1_DA, LVDS2_DA, LVDS3_DA, and LVDS4_DA. For this reason, the display device 100 may operate at a display mode suitable for one of two predetermined aspect ratios.

Figure 9:
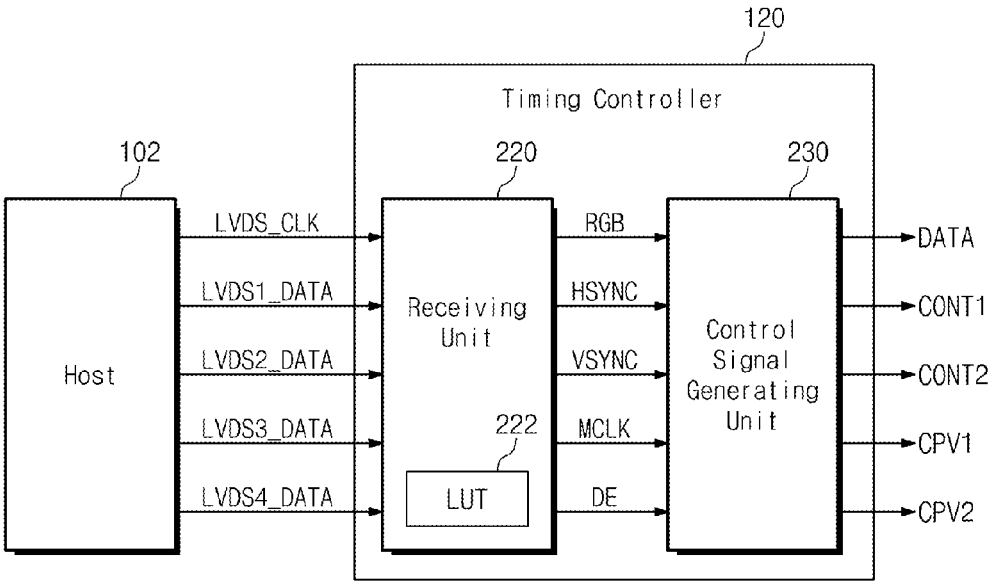
FIG. 9 is a block diagram illustrating a host and a timing controller according to another embodiment of the inventive concept.

FIG. 9 is a block diagram illustrating a host and a timing controller according to another embodiment of the inventive concept.

Referring to FIG. 9, a host 102 and a timing controller 120 may be connected using an LVDS interface as described with reference to FIG. 7. That is, the host 102 may send a clock signal LVDS_CLK and four pairs of data signals LVDS1_DATA, LVDS2_DATA, LVDS3_DATA, and LVDS4_DATA to the timing controller 120.

The timing controller 120 may include a receiving unit 220 and a control signal generating unit 230. The receiving unit 220 may convert the clock signal LVDS_CLK and the data signals LVDS1_DATA, LVDS2_DATA, LVDS3_DATA, and LVDS4_DATA into a main clock signal MCLK, an image signal RGB, a vertical synchronization signal VSYNC, a horizontal synchronization signal HSYNC, and a data enable signal DE.

The control signal generating unit 230 may generate a data signal DATA and a first control signal CONT1 to be provided to a data driver 140, a second control signal CONT2 to be provided to a gate driver 134, and first and second gate pulse signals CPV1 and CPV2 to be provided to a level shifter 132 in response to the main clock signal MCLK, the image signal RGB, the vertical synchronization signal VSYNC, the horizontal synchronization signal HSYNC, and the data enable signal DE.

In particular, the receiving unit 220 may sense an aspect ratio of an image signal from the clock signal LVDS_CLK and the data signals LVDS1_DATA, LVDS2_DATA, LVDS3_DATA, and LVDS4_DATA, and may decide a pulse width of each of the vertical synchronization signal VSYNC and the horizontal synchronization signal HSYNC according to the sensed aspect ratio. Alternatively, the receiving unit 220 may sense an area, in which a black image is displayed, from the clock signal LVDS_CLK and the data signals LVDS1_DATA, LVDS2_DATA, LVDS3_DATA, and LVDS4_DATA, and may decide a pulse width of each of the vertical synchronization signal VSYNC and the horizontal synchronization signal HSYNC according to the sensed black image display area. The black image display area may be sensed by counting the number of first-direction lines and/or the second direction lines, to which a data signal corresponding to a black image is successively input. The receiving unit may comprise a memory configured to store a pulse width setup signal corresponding to an aspect ratio of the data signals. The memory may be a look-up table LUT 222 which stores the pulse width of the horizontal synchronization signal HSYNC and the vertical synchronization signal according to the sensed aspect ratio.

The receiving unit 220 may sense a size of a black image display area according to the number of first-direction lines and/or the second direction lines, to which a data signal corresponding to a black image is successively input, and may decide a pulse width of each of the vertical synchronization signal VSYNC and the horizontal synchronization signal HSYNC according to a size of the sensed black image display area.

The receiving unit 220 may include a lookup table 222. The receiving unit 220 may decide a pulse width of each of the vertical synchronization signal VSYNC and the horizontal synchronization signal HSYNC corresponding to a sensed aspect ratio of the externally provided image signal, based on the lookup table 222.

The control signal generating unit 230 may generate the first control signal CONT1 to be provided to the data driver 140 and the second control signal CONT2 to be provided to the gate driver 134 according to pulse widths of the vertical synchronization signal VSYNC and the horizontal synchronization signal HSYNC.

FIGS. 10 to 14 are diagrams illustrating examples in which pulse widths of a vertical synchronization signal and a horizontal synchronization signal are varied according to an aspect ratio of an image signal received from a host.

Figure 10:
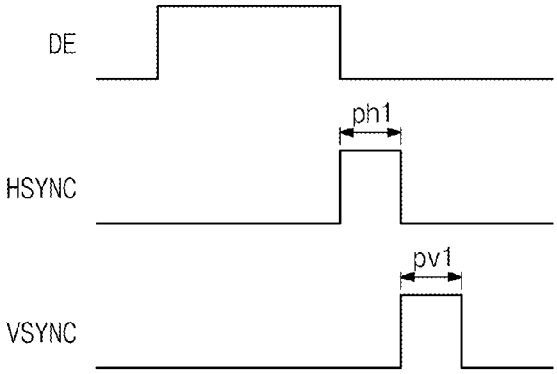
FIGS. 10 to 14 are diagrams illustrating examples in which pulse widths of a vertical synchronization signal and a horizontal synchronization signal are varied according to an aspect ratio of an image signal received from a host.

Referring to FIGS. 9 and 10, a receiving unit 220 of a timing controller 120 may generate a data enable signal DE and an image signal RGB from a clock signal LVDS_CLK and four pairs of data signals LVDS1_DATA, LVDS2_DATA, LVDS3_DATA, and LVDS4_DATA provided from a host 102. If an aspect ratio of the image signal RGB coincides with a predetermined aspect ratio of a display device 100, the horizontal synchronization signal HSYNC may transition to a high level by the receiving unit 220 when the data enable signal DE transitions to a low level from a high level, and the vertical synchronization signal VSYNC may transition to a high level by the receiving unit 220 when the horizontal synchronization signal HSYNC transitions to a low level from a high level. At this time, a high-level period of the horizontal synchronization signal HSYNC, that is, a pulse width ph1 and a pulse width pv1 of the vertical synchronization signal VSYNC may have a predetermined value corresponding to a normal mode, respectively.

Referring to FIGS. 9 and 11 to 14, if an aspect ratio of an image signal RGB generated from the clock signal LVDS_CLK and the data signals LVDS1_DATA, LVDS2_DATA, LVDS3_DATA, and LVDS4_DATA provided from the host 102 is different from a predetermined aspect ratio of the display device 100, the receiving unit 220 may decide pulse widths of the vertical and horizontal synchronization signals VSYNC and HSYNC as stored at a lookup table 222.

Pulse widths of the vertical and horizontal synchronization signals VSYNC and HSYNC according to an aspect ratio of an image signal RGB may be illustrated in the following table 1. Only, the aspect ratio of the display device 100 may be 16:9, for example.

TABLE 1

| Aspect ratio | Pulse width of HSYNC | Pulse width of VSYNC |
|---|---|---|
| 16:9 | ph1 | pv1 |
| 4:3 | ph2 | pv2 |
| 5:4 | ph3 | pv3 |
| 16:10 | ph4 | pv4 |
| 21:9 | ph5 | pv5 |

For example, if an aspect ratio of an image signal RGB is 4:3, the receiving unit 220 may set a pulse width pv2 of the vertical synchronization signal VSYNC to be longer than a pulse width pv1 at a normal mode (pv2>pv1). That is, the horizontal and vertical synchronization signals HSYNC and VSYNC may simultaneously transition to a high level from a low level at a falling edge where a data enable signal DE transitions to a low level from a high level.

If an aspect ratio of an image signal RGB is 5:4, the receiving unit 220 may set a pulse width pv3 of the horizontal synchronization signal HSYNC to be longer than a pulse width pv1 at a normal mode (pv3>pv1). That is, the horizontal synchronization signal HSYNC may transition to a high level from a low level at a rising edge where the data enable signal DE transitions to a high level from a low level.

In example embodiments, a maximum pulse width of the horizontal synchronization signal HSYNC and a maximum pulse width of the vertical synchronization signal VSYNC may be decided according to the whole number of distinguishable aspect ratios. That is, a maximum pulse width of the horizontal synchronization signal HSYNC and a maximum pulse width of the vertical synchronization signal VSYNC may be decided according to a size of a black image and an aspect ratio capable of being distinguished by the timing controller 120.

As illustrated in FIGS. 11 to 14, a maximum value of a pulse width of each of the horizontal synchronization signal HSYNC and the vertical synchronization signal VSYNC may be a value from a rising edge of the data enable signal DE until a falling edge of each of the horizontal and vertical synchronization signals HSYNC and VSYNC at a normal mode.

A control signal generating unit 230 in the timing controller 120 of FIG. 9 may operate at a normal mode or a down-sizing mode according to the data enable signal DE, the horizontal synchronization signal HSYNC, and the vertical synchronization signal VSYNC output from a receiving unit 220.

For example, the control signal generating unit 230 in the timing controller 120 may operate at the normal mode when the data enable signal DE, the horizontal synchronization signal HSYNC, and the vertical synchronization signal VSYNC illustrated in FIG. 10 are received from the receiving unit 220. Alternatively, the control signal generating unit 230 in the timing controller 120 may operate at the down-sizing mode when the data enable signal DE, the horizontal synchronization signal HSYNC, and the vertical synchronization signal VSYNC illustrated in FIGS. 11 to 14 are received from the receiving unit 220.

TABLE 2

| Pulse width of HSYNC | Pulse width of VSYNC | HDET | VDET |
|---|---|---|---|
| ph1 | pv1 | 00010 | 00001 |
| ph2 | pv2 | 00010 | 00011 |
| ph3 | pv3 | 11110 | 00001 |
| ph4 | pv4 | 00010 | 11111 |
| ph5 | pv5 | 11110 | 11111 |

The table 2 may show horizontal sensing data HDET and vertical sensing data VDET which a control signal generating unit 230 generates according to pulse widths of the horizontal and vertical synchronization signals HSYNC and VSYNC.

The control signal generating unit 230 may generate the horizontal sensing data HDET and the vertical sensing data VDET by sensing the horizontal and vertical synchronization signals HSYNC and VSYNC from a point of time when a data enable signal DE transitions to a high level from a low level until a point of time when the vertical synchronization signal VSYNC transitions to a low level from a high level.

For example, in the case that the horizontal and vertical synchronization signals HSYNC and VSYNC as illustrated in FIG. 10 are received, the control signal generating unit 230 may generate the horizontal sensing data HDET of '00010' and the vertical sensing data VDET of '00001'. When the horizontal sensing data HDET is '00010' and the vertical sensing data VDET is '00001', the control signal generating unit 230 may operate at a normal mode.

Figure 11:
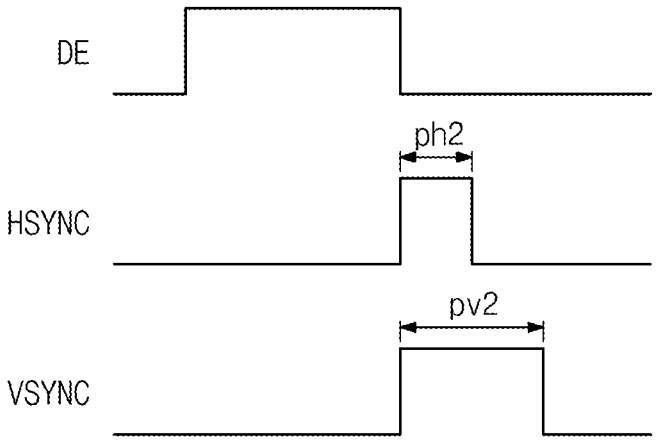

In the case that the horizontal and vertical synchronization signals HSYNC and VSYNC as illustrated in FIG. 11 are received, the control signal generating unit 230 may generate the horizontal sensing data HDET of '00010' and the vertical sensing data VDET of '00011'. When the horizontal sensing data HDET is '00010' and the vertical sensing data VDET is '00011', the control signal generating unit 230 may operate at a down-sizing mode suitable for a 4:3 aspect ratio.

Figure 12:
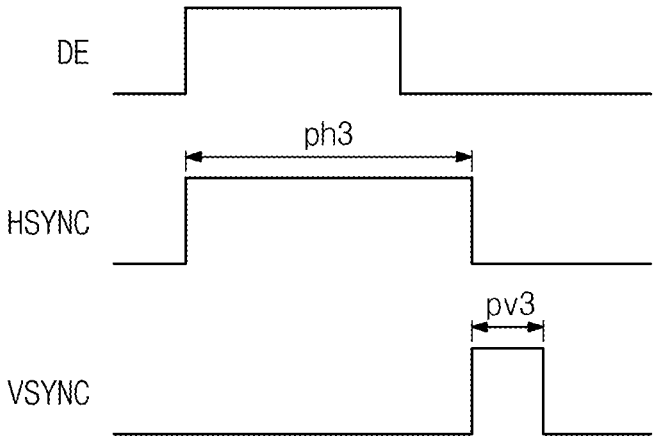
Figure 13:
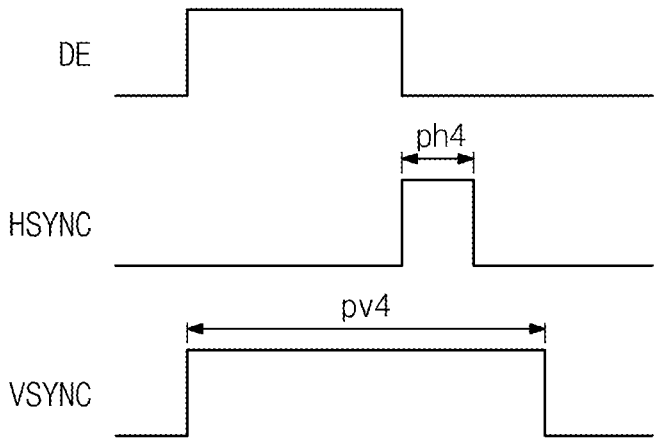
Figure 14:
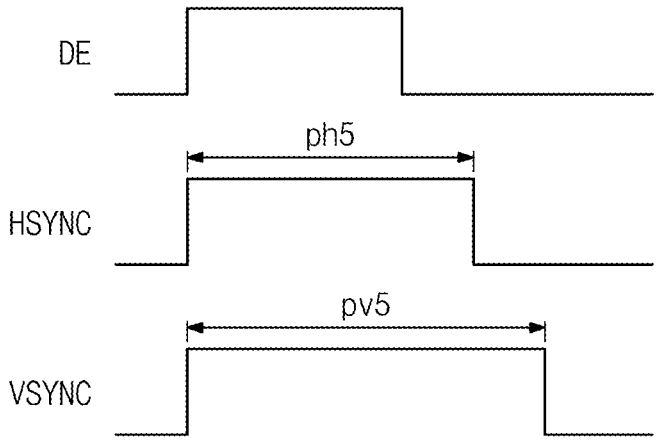

In the case that the horizontal and vertical synchronization signals HSYNC and VSYNC as illustrated in FIG. 12 are received, the control signal generating unit 230 may generate the horizontal sensing data HDET of '11110' and the vertical sensing data VDET of '00001'. When the horizontal sensing data HDET is '11110' and the vertical sensing data VDET is '00001', the control signal generating unit 230 may operate at a down-sizing mode suitable for a 5:4 aspect ratio.

In example embodiments, a display device 100 may generate 5-bit horizontal synchronization data HDET from the horizontal synchronization signal HSYNC and 5-bit vertical sensing data VDET from the vertical synchronization signal VSYNC. Since a least significant bit LSB of the horizontal synchronization data HDET has to be '0' and a least significant bit LSB of the vertical synchronization data VDET has to be '1', an aspect ratio may be distinguished by four upper bits of the horizontal synchronization data HDET and four upper bits of the vertical sensing data VDET. For example, the 5-bit horizontal synchronization data HDET may be one of '00010', '00110', '01110', and '11110', and the 5-bit vertical sensing data VDET may be one of '00011', '00111', '01111', and '11111'. Therefore, it is possible to distinguish 16 (4 by 4) aspect ratios or a size of a black image display area using the 5-bit horizontal synchronization data HDET and the 5-bit vertical sensing data VDET. In other words, the display device 100 may distinguish 16 aspect ratios provided from a host 102.

Each of the vertical sensing data VDET and the horizontal synchronization data HDET may not be limited to a 5-bit data width. The vertical sensing data VDET and the horizontal synchronization data HDET may be changed variously in view of a pulse width of a data enable signal and so on.

Figure 15:
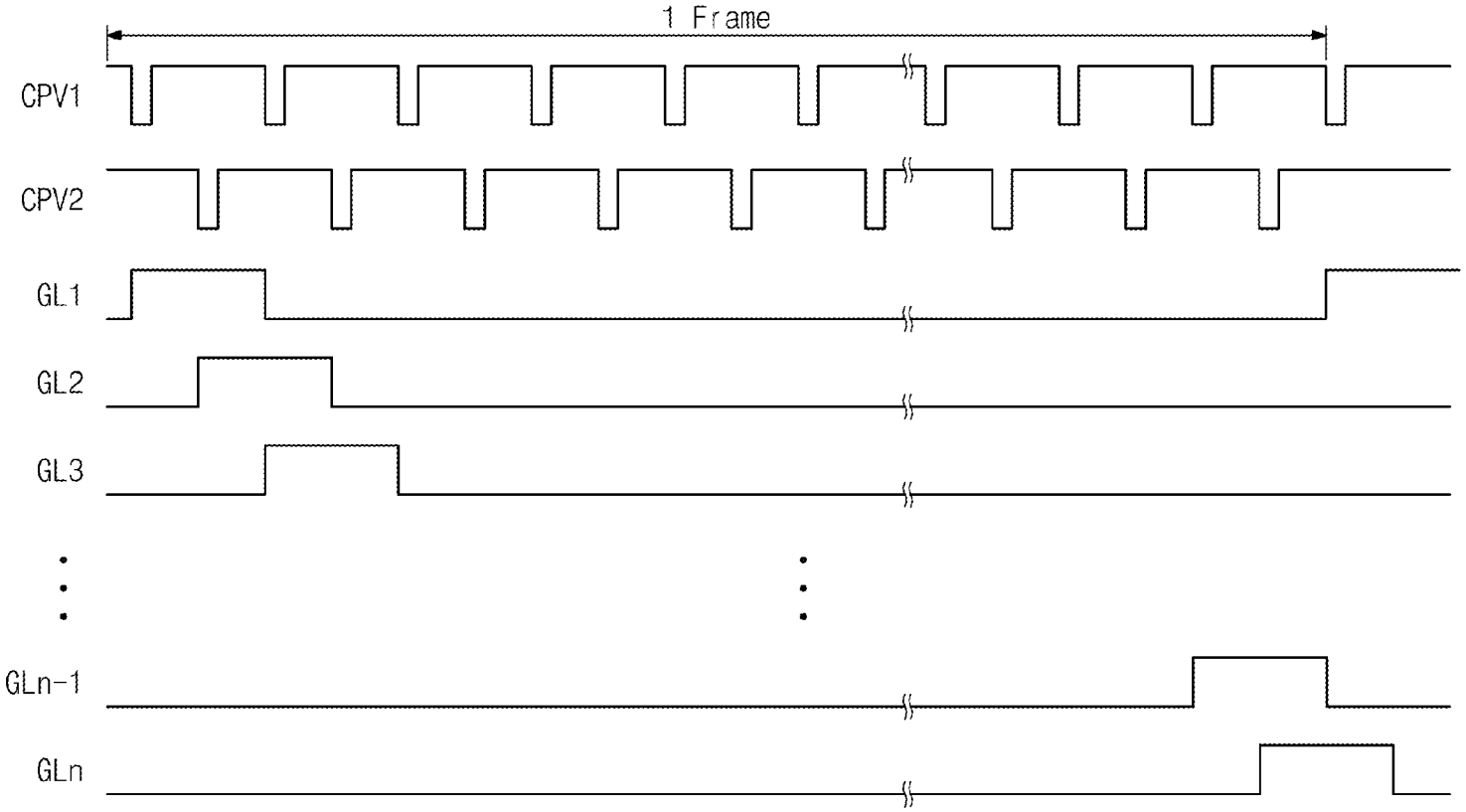
FIG. 15 is a diagram illustrating variations in first and second gate pulse signals from a control signal generating unit of FIG. 9 and gate line signals during a normal mode.

FIG. 15 is a diagram illustrating variations in first and second gate pulse signals from a control signal generating unit of FIG. 9 and gate line signals during a normal mode.

Referring to FIGS. 9, 10, and 15, during a normal mode, a control signal generating unit 230 may generate first and second gate pulse signals CPV1 and CPV2 in response to a data enable signal DE, a horizontal synchronization signal HSYNC, and a vertical synchronization signal VSYNC. A level shifter 132 of FIG. 1 may output first and second gate clock signals CKV1 and CKV2 in response to the first and second gate pulse signals CPV1 and CPV2 from a timing controller 120. A gate driver 134 may sequentially drive gate lines GL1 to GLn in response to a second control signal CONT2 from the timing controller 120 and the first and second gate clock signals CKV1 and CKV2. Therefore, all gate lines GL1 to GLn may be sequentially driven with a gate-on voltage in synchronization with the first and second gate clock signals CKV1 and CKV2 during one frame.

Figure 16:
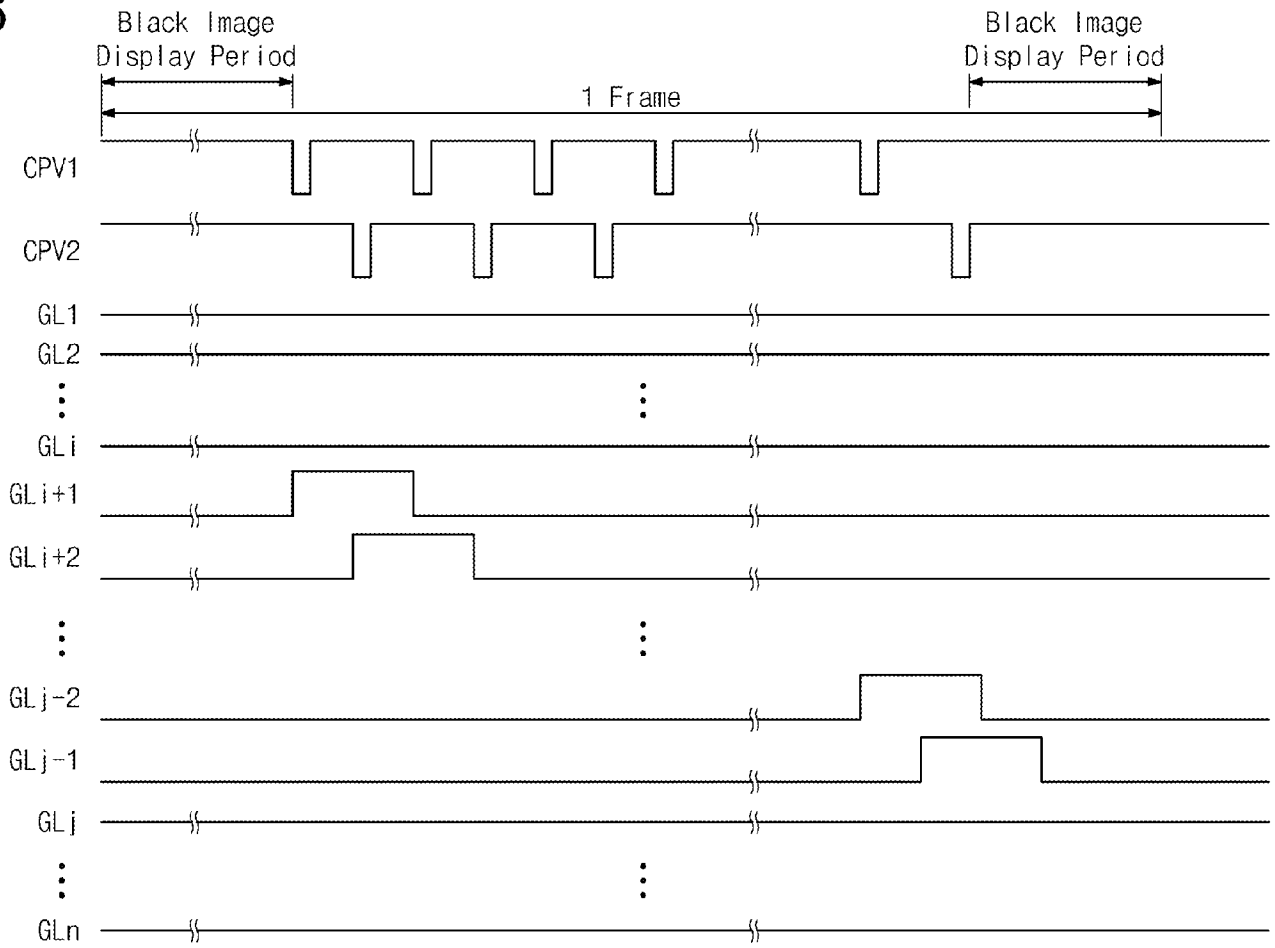
FIG. 16 is a diagram illustrating variations in first and second gate pulse signals from a control signal generating unit of FIG. 9 and gate line signals during a down-sizing mode.

FIG. 16 is a diagram illustrating variations in first and second gate pulse signals CPV1 and CPV2 from a control signal generating unit 230 of FIG. 9 and gate line signals during a down-sizing mode.

When an aspect ratio of a display device is 16:9 and an image signal provided from a host 102 and converted at a receiving unit 222 is 21:9, as illustrated in FIG. 5, a black image may be displayed at upper and lower sides of a display panel 110.

In exemplary embodiments, according to the horizontal sensing data HDET and the vertical sensing data VDET, the control signal generating unit 230 generates the first and the second gate pulse signals CPV1 and CPV2 which include a gate off signal for gate lines corresponding to the black image display areas BK3 and BK4.

That is, first and second gate pulse signals CPV1 and CPV2 for gate lines GL1 to GLi corresponding to the black image display area BK3 and gate lines GLj to GLn corresponding to the black image display area BK4 may be set to a gate-off voltage.

Since the gate lines GL1 to GLi and GLj to GLn corresponding to the black image display areas BK3 and BK4 are not driven, pixels connected with the gate lines GL1 to GLi and GLj to GLn may not be supplied of a data voltage. Therefore, it is possible to reduce power consumption of the display panel 110 during a down-sizing mode.

Figure 17:
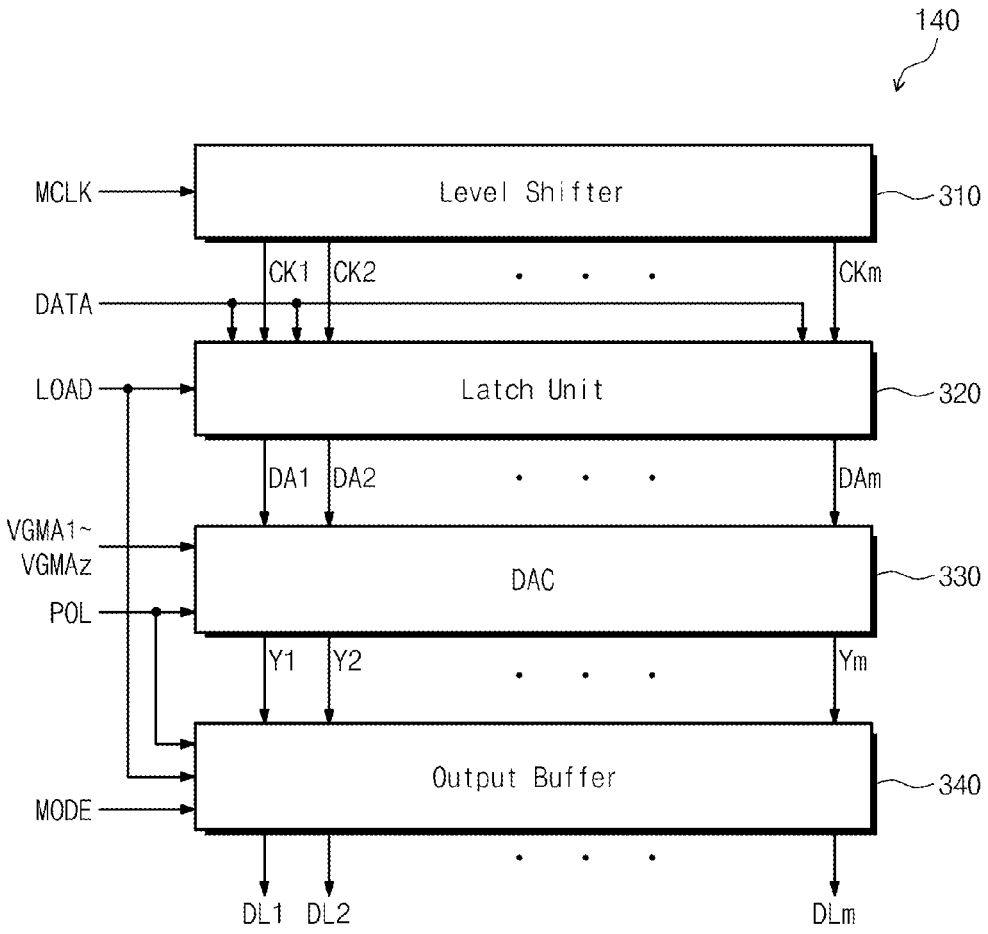
FIG. 17 is a block diagram schematically illustrating a data driver in FIG. 1.

FIG. 17 is a block diagram schematically illustrating a data driver in FIG. 1.

Referring to FIG. 17, a data driver 140 may include a shift register 310, a latch unit 320, a digital-to-analog converter 330, and an output buffer 340.

In FIG. 17, a main clock signal MCLK, a polarity inversion signal POL, a line latch signal LOAD, and a mode signal MODE may be signals included in a first control signal CONT1 provided from a timing controller 120 of FIG. 1.

The shift register 310 may sequentially activate latch clock signals CK1 to CKm in synchronization with the main clock signal MCLK. The latch unit 320 may latch a data signal DATA in synchronization with latch clock signals CK1 to CKm from the shift register 310, and may simultaneously provide latch digital image signals DA1 to DAm to the digital-to-analog converter 330 in response to the line latch signal LOAD.

The digital-to-analog converter 330 may output gamma reference voltages VGMA1 to VGMAz corresponding to the latch digital image signals DA1 to DAm to the output buffer 340 as analog image signals Y1 to Ym.

The output buffer 340 may output the analog image signals Y1 to Ym from the digital-to-analog converter 330 to data lines DL1 to DLm in response to the line latch signal LOAD. Also, the output buffer 340 may output the analog image signals Y1 to Ym to all or a part of the data lines DL1 to DLm according to the mode signal MODE.

A control signal generating unit 230 in a timing controller 120 of FIG. 9 may output the mode signal MODE having a first level (e.g., a low level) when horizontal and vertical synchronization signals HSYNC and VSYNC indicate a normal mode and the mode signal MODE having a second level (e.g., a high level) when the horizontal and vertical synchronization signals HSYNC and VSYNC indicate a down-sizing mode. If the mode signal MODE has the first level indicating the normal mode, the output buffer 340 may output the analog image signal Y1 to Ym to all data lines DL1 to DLm. If the mode signal MODE has the second level indicating the down-sizing mode, the mode signal MODE may include information for data lines DL1 to DLm in which black images are displayed.

For example, if an aspect ratio of the display panel 110 is 16:9 and an aspect ratio of an image signal RGB is 4:3, as illustrated in FIG. 4, a black image may be displayed at left and right sides of the display panel 110. The output buffer 340 may be disabled corresponding to a black image data columns which have the black image display areas BK1 and BK2 at left and right sides of the display panel 110 in response to the mode signal MODE having the second level. Thus, there may be reduced a power consumed at the display panel 110 during the down-sizing mode.

As described with reference to FIG. 6, when a first-direction length b1 and a second-direction length a1 of a display area of a display panel 110 are longer than a first-direction length b3 and a second-direction length a3 of an image signal GB (b1>b3, a1>a3), the control signal generating unit 230 in the timing controller 120 may output not only first and second gate pulse signals CPV1 and CPV2 as illustrated in FIG. 16 but also the mode signal MODE having the second level. Thus, gate lines placed at a black image display area BK5 of the edge of an image-displayed area of the display panel 110 may not be driven with a gate-on voltage, and analog image signals may not be output to data lines.

Figure 18:
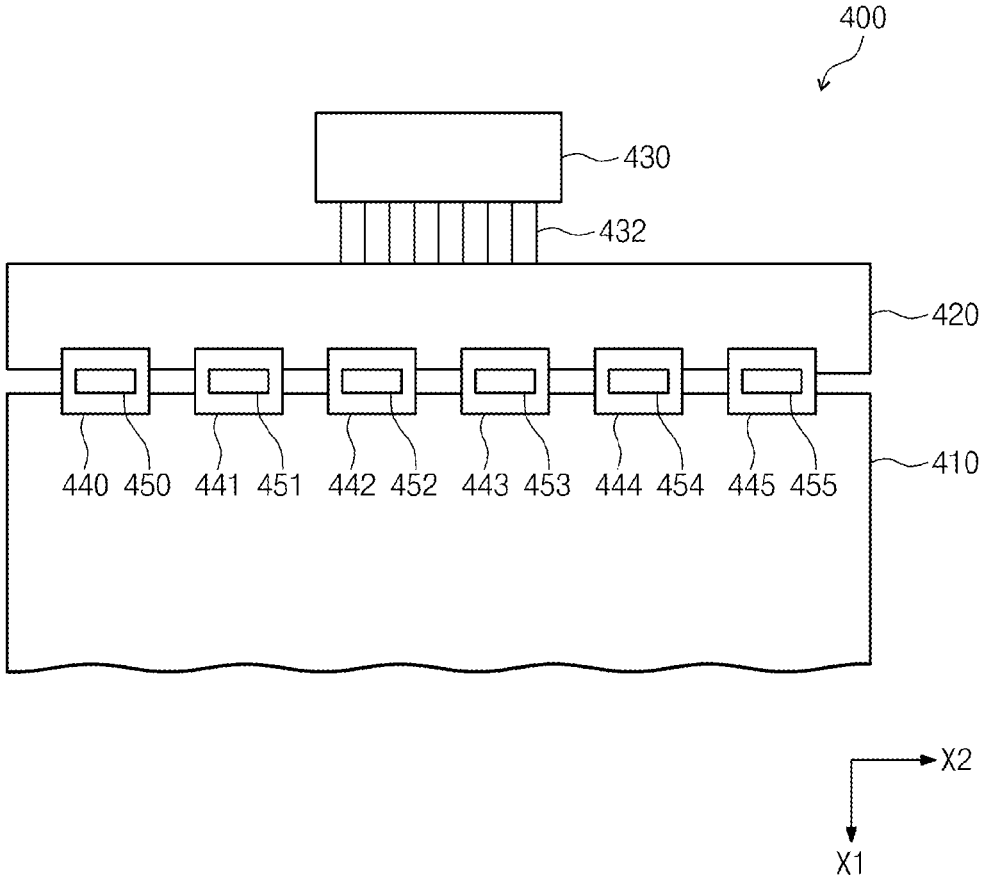
FIG. 18 is a top view of a display device having an aspect ratio sensing function.

FIG. 18 is a top view of a display device having an aspect ratio sensing function.

Referring to FIG. 18, a display device 400 may include a display panel 410, a circuit substrate 420, a timing controller 430, and a plurality of data driving circuits 440 to 445.

A glass substrate, a silicon substrate, or a film substrate may be used as the display panel 410. Although not shown in figures, gate driving circuits may be implemented by a circuit using oxide semiconductor, crystalline semiconductor, or poly crystalline semiconductor at one side of the display panel 410. The circuit substrate 420 may include a variety of circuits for driving the display panel 410. The circuit substrate 420 may include a plurality of wires for connection with the timing controller 430 and the data driving circuit 460.

The timing controller 430 may be electrically connected with the circuit substrate 430 via a cable 432. The timing controller 430 may provide the data driving circuits 440 to 445 with a data signal and a first control signal CONT1 via the cable 432.

Each of the data driving circuits 440 to 445 may be implemented by a table carrier package (TCP) or a chip on film (COF), and each of data driver integrated circuits 450 to 455 may be mounted. Each of the data driver integrated circuits 450 to 455 may drive a plurality of data lines in response to the data signal and the first control signal CONT1 from the timing controller 430. The data driver integrated circuits 450 to 455 may be mounted directly on the display panel 410, not disposed on the circuit substrate 420.

Similarly with FIGS. 4 and 6, in the case that a second-direction length of an image signal RGB is shorter than a second-direction length of a display area of the display panel 410, a black image may be displayed at left and right sides of the display panel 410. For example, in the case that a ratio of a second-direction length of the display panel 410 to a second-direction length of the image signal RGB is 3:2, four data driver integrated circuits 451 to 454 of six data driver integrated circuits 450 to 455 may output analog image signals to data lines. Data driver integrated circuits 450 and 455 placed at left and right sides of the display panel 410 may remain at a non-operating state. In this case, it is possible to reduce power consumption of the display panel 410 and power consumption of the data driver integrated circuits 450 and 455.

A display device of the inventive concept may sense an aspect ratio of an input image signal to generate horizontal and vertical synchronization signals each having a pulse width corresponding to the sensed aspect ratio.

Also, when receiving an image signal having an aspect ratio different from that of the display panel, the display device of the inventive concept may not provide a data signal and/or a gate signal to a non-display area where an image signal is not displayed. Thus, power consumption may be reduced.

Further, although an aspect ratio of an image signal input from the external device is changed during operation of the display device, the display device of the inventive concept may sense an aspect ratio of an image signal in real time to display an image at the display panel according to the sensed aspect ratio.

While the inventive concept has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. A display device comprising:

a display panel including a plurality of pixels connected with a plurality of gate lines and a plurality of data lines;

a gate driving unit configured to drive the plurality of gate lines;

a data driver configured to drive the plurality of data lines; and a timing controller configured to generate a plurality of control signals for controlling the gate driving unit and the data driver in response to externally provided clock signal and data signals, wherein the timing controller converts the data signals into an image data signal, a horizontal synchronization signal, a vertical synchronization signal, and a data enable signal, a pulse width of each of the horizontal synchronization signal and the vertical synchronization signal corresponding to an aspect ratio of the data signals or a size of a black image display area, wherein the timing controller generates the plurality of control signals according to the image data signal, the data enable signal, and pulse widths of the horizontal synchronization signal and the vertical synchronization signal, and wherein, when the aspect ratio of the data signals is different from an aspect ratio of the display device, the timing controller sets the pulse width of at least one of the vertical synchronization signal and the horizontal synchronization signal to be longer than a pulse width at a normal mode.

2. The display device of claim 1, wherein the timing controller comprises:

a receiving unit configured to convert the clock signal and the data signals into the image data signal, the horizontal synchronization signal, the vertical synchronization signal, and the data enable signal; and a control signal generating unit configured to generate the plurality of control signals according to the image data signal, the data enable signal, and the pulse widths of the horizontal synchronization signal and the vertical synchronization signal, wherein, when the aspect ratio of the data signals is different from the aspect ratio of the display device, the receiving unit sets the pulse width of the horizontal synchronization signal to be longer than the pulse width at the normal mode.

3. The display device of claim 2, wherein the timing controller further comprises:

a memory configured to store a pulse width setup signal corresponding to the aspect ratio of the data signals.

4. The display device of claim 3, wherein the pulse width setup signal is a signal for changing a pulse width of at least one of the horizontal synchronization signal and the vertical synchronization signal.

5. The display device of claim 4, wherein the timing controller changes an activation point of time of the horizontal synchronization signal in response to the pulse width setup signal.

6. The display device of claim 4, wherein the timing controller changes an activation point of time of the vertical synchronization signal in response to the pulse width setup signal.

7. The display device of claim 4, wherein the timing controller changes an activation point of time of the vertical synchronization signal and an activation point of time of the horizontal synchronization signal in response to the pulse width setup signal.

8. The display device of claim 7, wherein the timing controller changes an activation point of time of the vertical synchronization signal in response to the pulse width setup signal.

9. The display device of claim 1, wherein the plurality of control signals generated by the timing controller includes a gate pulse signal to be provided to the gate driving unit and a mode signal, the mode signal having a first level when horizontal and vertical synchronization signals indicate the normal mode and the mode signal having a second level when the horizontal and vertical synchronization signals indicate a down-sizing mode, and an image signal to be provided to the data driver, wherein, when the aspect ratio of the data signals are greater the aspect ratio of the display device, the pulse width of the horizontal synchronization signal is longer than the pulse width of the horizontal synchronization signal when the aspect ratio of the data signals is equal to the aspect ratio of the display device.

10. The display device of claim 9, wherein the timing controller changes at least one of the gate pulse signal and the mode signal when the aspect ratio of the data signals is different from a predetermined aspect ratio or a black image display area is detected.

11. The display device of claim 10, wherein the timing controller sets the mode signal to a first level when the aspect ratio of the data signals is less than the aspect ratio of the display panel.

12. The display device of claim 11, wherein the data driver does not provide the image signal to a data line connected with pixels placed at a part of the display panel when the mode signal has the first level.

13. The display device of claim 10, wherein the timing controller sets a predetermined period of the gate pulse signal to a turn-off level when the aspect ratio of the data signals is different from the predetermined aspect ratio or the black image display area is detected.

14. The display device of claim 13, wherein the gate driving unit comprises:

a level shifter configured to output a gate clock signal in response to the gate pulse signal; and a gate driver configured to sequentially drive the plurality of gate lines in response to the gate clock signal, wherein the gate driver does not drive a corresponding gate line during the turn-off level of the gate clock signal.

15. A display device driving method comprising:

receiving a clock signal and data signals from an external device;

converting the clock signal and the data signals into an image data signal, a horizontal synchronization signal, a vertical synchronization signal, and a data enable signal; and displaying an image on a display panel in response to the image data signal, the horizontal synchronization signal, the vertical synchronization signal, and the data enable signal, wherein the converting the clock signal and the data signals comprises changing at least one of a pulse width of the horizontal synchronization signal and the vertical synchronization signal corresponding to an aspect ratio of the data signals or a size of a black image display area, and wherein, when the aspect ratio of the data signals is different from an aspect ratio of the display device, the timing controller sets the pulse width of at least one of the vertical synchronization signal and the horizontal synchronization signal to be longer than a pulse width at a normal mode.

16. The display device driving method of claim 15, wherein displaying an image on a display panel comprises:

setting one of a normal mode and a down-sizing mode according to a pulse width of each of the horizontal synchronization signal and the vertical synchronization signal, wherein, when the aspect ratio of the data signals is different from the aspect ratio of the display device, the receiving unit sets the pulse width of at least one of the horizontal synchronization signal to be longer than the pulse width at a normal mode.

17. The display device driving method of claim 16, wherein displaying the image on the display panel further comprises controlling such that a part of gate lines of the display panel is not driven during the down-sizing mode.

18. The display device driving method of claim 15, wherein displaying the image on the display panel further comprises controlling such that a part of data lines of the display panel is not driven during the down-sizing mode.

* * * * *